US005728040A

United States Patent [19]

Schill et al.

[11] Patent Number: 5,728,040

[45] Date of Patent: Mar. 17, 1998

[54] VARIABLE VOLUME CELL SAVER BOWL

[75] Inventors: David M. Schill, Knoxville, Tenn.; Joseph G. Schill, Lynchburg, Va.

[73] Assignee: Schill Enterprises, Inc., Knoxville, Tenn.

[21] Appl. No.: 708,830

[22] Filed: Sep. 9, 1996

[51] Int. Cl.[6] ..... B04B 1/08

[52] U.S. Cl. ..... 494/48; 494/67

[58] Field of Search ..... 494/41, 44, 47, 494/48, 56, 65, 67, 83, 84, 85

[56] References Cited

U.S. PATENT DOCUMENTS

| | | | |
|---|---|---|---|
| 260,412 | 7/1882 | Quimby . | |
| 3,930,609 | 1/1976 | Nelson . | |
| 4,684,361 | 8/1987 | Feldman et al. | 494/41 |
| 4,943,273 | 7/1990 | Pages | 494/41 |
| 4,983,158 | 1/1991 | Headley | 494/41 |
| 5,100,372 | 3/1992 | Headley | 494/41 |
| 5,186,708 | 2/1993 | Stroucken et al. | 494/41 |
| 5,306,423 | 4/1994 | Hultsch . | |
| 5,405,308 | 4/1995 | Headley et al. | 494/67 |
| 5,441,475 | 8/1995 | Storruste et al. | 494/48 |
| 5,514,070 | 5/1996 | Pages | 494/41 |

*Primary Examiner*—Charles E. Cooley
*Attorney, Agent, or Firm*—Pitts & Brittian, P.C.

[57] ABSTRACT

A variable volume cell saver bowl for to centrifuge blood for collection of red blood cells therefrom. The variable volume cell saver bowl is designed to vary the volume within the bowl to accommodate blood collections of various volumes in order to use the entire recovered volume of blood. The bowl includes generally an outer shell and an inner shell. The outer shell defines integrally formed first and second side walls, the first side wall having a frusto-conical configuration and the second side wall having a cylindrical configuration extending coaxially away from the larger diameter end of the first side wall. The inner shell is disposed concentrically within the outer shell and defines a frusto-conical configuration similar to that of the outer shell first side wall. A centrally disposed hollow core is carried within the inner shell such that the inner shell defines a substantially toroidal configuration having a trapezoidal cross-section. The inlet portion of an inlet/outlet coupling is directed through the hollow core of the inner shell and eventually to the upper end of the outer shell and through the outlet side of the coupling. A piston head is secured to the inner shell lower end wall via at least one spacer. Rotation is imparted on the piston shall or outer shell in order to rotate the bowl to create centrifugal force within the bowl. A linear displacement device is journalled to the distal end of the piston shaft in order to move the inner shell toward either the top or bottom end wall of the outer shell, thus reducing or increasing the volume within the bowl.

6 Claims, 3 Drawing Sheets

VARIABLE VOLUME CELL SAVER BOWL

TECHNICAL FIELD

This invention relates to the field of blood processing. More specifically, this invention relates to a variable volume cell saver bowl used in centrifugal processing of blood collected during a surgical procedure for re-introduction into the body from which it was collected.

BACKGROUND ART

In the field of surgery, it is well known that blood is collected from a patient for various reasons. The blood that is collected is commonly centrifuged in order to separate the red blood cells from fluid in the blood, with the fluid being disposed. The final product of concentrated red blood cells is then re-introduced into the patient's blood system in order to thicken the blood. Specifically, the percentage of red blood cells in the blood, the hematocrit level, is increased.

Conventional collection bowls currently in use define a fixed volume. A typical collection bowl 10A is illustrated in FIG. 1. The bowl 10A includes an outer wall 14A and an inner wall 16A, with a particular volume defined therebetween and within which the blood is collected and centrifuged. Waste fluid is expelled and the red blood cells are kept within the volume. The inner wall 16A and outer wall 14A are fixed in relation to each other such that the volume within the bowl 10A is fixed. The inner wall 16A may be configured with a stepped frusto-conical shape as illustrated in solid lines, or with a frusto-conical shape as illustrated with broken lines. In either configuration, the volume within the bowl 10A is determined by the configuration and dimensions of the inner wall, and cannot be changed with the particular bowl 10A being used. Although various sizes may be chosen, the bowl 10A must be full prior to re-introducing the red blood cells into the patient's blood system. Thus, if a surgical procedure is completed such that no more blood is to be collected, and if the collection bowl is not full, any red blood cells that have been collected are disposed. In another scenario, the red blood cells may be required during a surgical procedure, but not available because the collection bowl 10A is not yet full. In such an instance, the surgeon must wait until the appropriate amount of blood is collected such that it may be processed and the red blood cells harvested.

Other devices have been produced for separating components in a fluid using centrifugal separation. Typical of the art are those devices disclosed in the following U.S. patents:

| U.S. Pat. No. | Inventor(s) | Issue Date |
|---|---|---|
| 260,412 | E. E. Quimby | July 4, 1882 |
| 3,930,609 | K. Nelson | Jan. 6, 1976 |
| 5,186,708 | K. Stroucken, et al. | Feb. 16, 1993 |
| 5,306,423 | G. Hultsch | Apr. 26, 1994 |
| 5,405,308 | T. D. Headley, et al. | Apr. 11, 1995 |
| 5,441,475 | S. Storruste, et al. | Aug. 15, 1995 |

Of these devices, Quimby ('412) discloses a centrifugal separator for the separation of starch from liquid matter. The separator has a removable rim such that starch may be removed. Although the outer wall is movable with respect to the stripping disk, the volume within the separator, during operation, is not variable.

The device disclosed by Nelson ('609) is a centrifuge designed to prevent the admission of air into the bowl during discharge of sludge in order to maintain a normal liquid level. Nelson does not disclose a means for varying the volume defined within the centrifuge, regardless of whether or not it is in use.

Stroucken, et al. ('708), teach a centrifugal separator having a rotor body with a movable wall. The rotor of the '708 device includes two axially separated end walls and a surrounding wall disposed between, and separate from, the two end walls. The surrounding wall may be moved axially with respect to either or both end walls and is capable of elastic deformation in response to liquid pressure in the separation chamber. However, Stroucken, et al., do not teach a means for varying the volume within the separating chamber, especially to reduce the volume during operation of the same.

The device disclosed by Hultsch ('423) is a discontinuously operating filter centfifuge. The '423 device is constructed such that liquid is discharged from a filter cake, the filter cake being discharged from a filter bag when shifting out of the mouth of the drum, thus enabling the inspection of the interior of the drum. Hultsch, as in the above references, fails to teach a variable volume collection receptacle, and especially a receptacle whose volume may be reduced during operation of the centrifuge.

Headley, et al. ('308), disclose a disposable centrifuge rotor and core for blood processing whereby a plurality of projections extend into the processing region to minimize formation of fluid Coriolis waves. The '308 device is used in conjunction with a fixed volume centrifugal separator. Thus, Headley, et al., do not disclose a variable volume bowl.

The '475 device disclosed by Storruste, et at., includes a separation chamber housing split into what are described as mating, unhinged clamshell sections. Although the two sections are movable axially away from each other, such movement is provided for discharge of material from within the separation chamber. As with the previous devices, the '475 device does not provide for variance of the volume within the separation chamber, and especially does not allow for the volume within the chamber to be reduced during operation of the centrifuge.

Therefore, it is an object of this invention to provide a means for varying the volume within the separation chamber of a centfifuge in order to accommodate variations in the volume of fluid collected such that, in the instance of collected blood, the desired component may be removed from the fluid and used as needed.

It is a further object of the present invention to provide a variable volume cell saver bowl for use in collecting red blood cells from blood collected during surgery for re-introduction into the patient in order to elevate the hematocrit level of the patient, the bowl volume being adjustable during operation of the device to accommodate various volumes of blood collected.

As a result, it is a further object of the present invention whereby the volume within the separation chamber may be reduced such that lower volumes of blood collected may be immediately centrifuged to collect whatever red blood cells are present.

DISCLOSURE OF THE INVENTION

Other objects and advantages will be accomplished by the present invention which serves to centrifuge blood for collection of red blood cells therefrom. The variable volume cell saver bowl is designed to vary the volume within the bowl to accommodate blood collections of various volumes in order to use the entire recovered volume of blood, thereby reducing the amount of wasted blood. The bowl is used in certain circumstances to reduce the volume within the bowl in order to immediately recover red blood cells and re-introduce the same into the patient in order to raise the hematocrit level and increase the likelihood of success of the operation being performed on the patient.

The bowl includes generally an outer shell and an inner shell. The outer shell defines a first side wall having a frusto-conical configuration and a second side wall having a cylindrical configuration, the larger diameter of the first side wall having the same cross-section of the second side wall. The first side wall is sloped at an angle θ with respect to the central axis of the bowl. The outer shell first and second side walls are integrally formed. Upper and lower end walls are provided for closing the upper end of the outer shell first side wall and the lower end of the outer shell second side wall, respectively.

The inner shell is disposed concentrically within the outer shell and defines a frusto-conical configuration sloped at the angle θ with respect to the central axis of the bowl. A centrally disposed hollow core is carried within the inner shell such that the inner shell defines a substantially toroidal configuration having a trapezoidal cross-section.

An inlet/outlet coupling is carried by the outer shell upper end wall through an opening defined thereby. In order to allow rotation of the bowl about its longitudinal axis, the outer shell is secured to the inlet/outlet coupling using a bearing, seal, or other such device. The inlet portion of the coupling is directed through the hollow core of the inner shell and eventually to the upper end of the outer shell and through the outlet side of the coupling.

In order to centrifuge the blood, the bowl is rotated about its central axis. The inlet/outlet coupling is stationary with respect to the bowl, as a result of the bearing provided between the upper end wall of the outer shell and the inlet/outlet coupling. A piston is secured to the inner shell and a rotation imparting force is applied to the piston. A piston head is secured to the inner shell lower end wall via at least one spacer. Each spacer is secured at one end to the piston head and at the other end to the inner shell lower end wall such that the inner shell is fixed in relation to the piston. The piston head is configured to be closely received within the second side wall of the outer shell. A seal is carried by the piston head and is interposed between the piston head and the outer shell second side wall. The piston includes a shaft carried by the piston head and received through an opening defined by the outer shell lower end wall. A conventional rotation imparting device is used to impart rotation on the piston shaft, and thus the piston head, the inner shell and the outer shell. In an alternate embodiment, the rotation imparting device may impart rotation directly on the outer shell, thus likewise rotating the piston and the inner shell.

In order to accommodate for variation in volumes during operation of the bowl, the bowl of the present invention is provided with a linear displacement device. The linear displacement device is journalled to the distal end of the piston shaft using a conventional bearing such that the piston shaft may rotate while the linear displacement device remains relatively still. The linear displacement device includes a rack and pinion device whereby as a crank is turned, the rack portion of the linear displacement device is moved linearly, thus moving the inner shell toward either the top or bottom end wall of the outer shell, thus reducing or increasing the volume within the bowl.

BRIEF DESCRIPTION OF THE DRAWINGS

The above mentioned features of the invention will become more dearly understood from the following detailed description of the invention read together with the drawings in which.

BEST MODE FOR CARRYING OUT THE INVENTION

A variable volume cell saver bowl incorporating various features of the present invention is illustrated generally at 10 in the figures. The variable volume cell saver bowl, or bowl 10, is designed for centrifuging blood for collection of red blood cells therefrom. Moreover, in the preferred embodiment the bowl 10 is designed to vary the volume within the bowl 10 to accommodate blood collections of various volumes in order to use the entire recovered volume of blood, thereby reducing the mount of wasted blood. In certain circumstances, the ability to reduce the volume within the bowl 10 in order to immediately recover red blood cells and re-introduce the same into the patient in order to raise the hematocrit level will increase the likelihood of success of the operation being performed on the patient.

Figure 1:
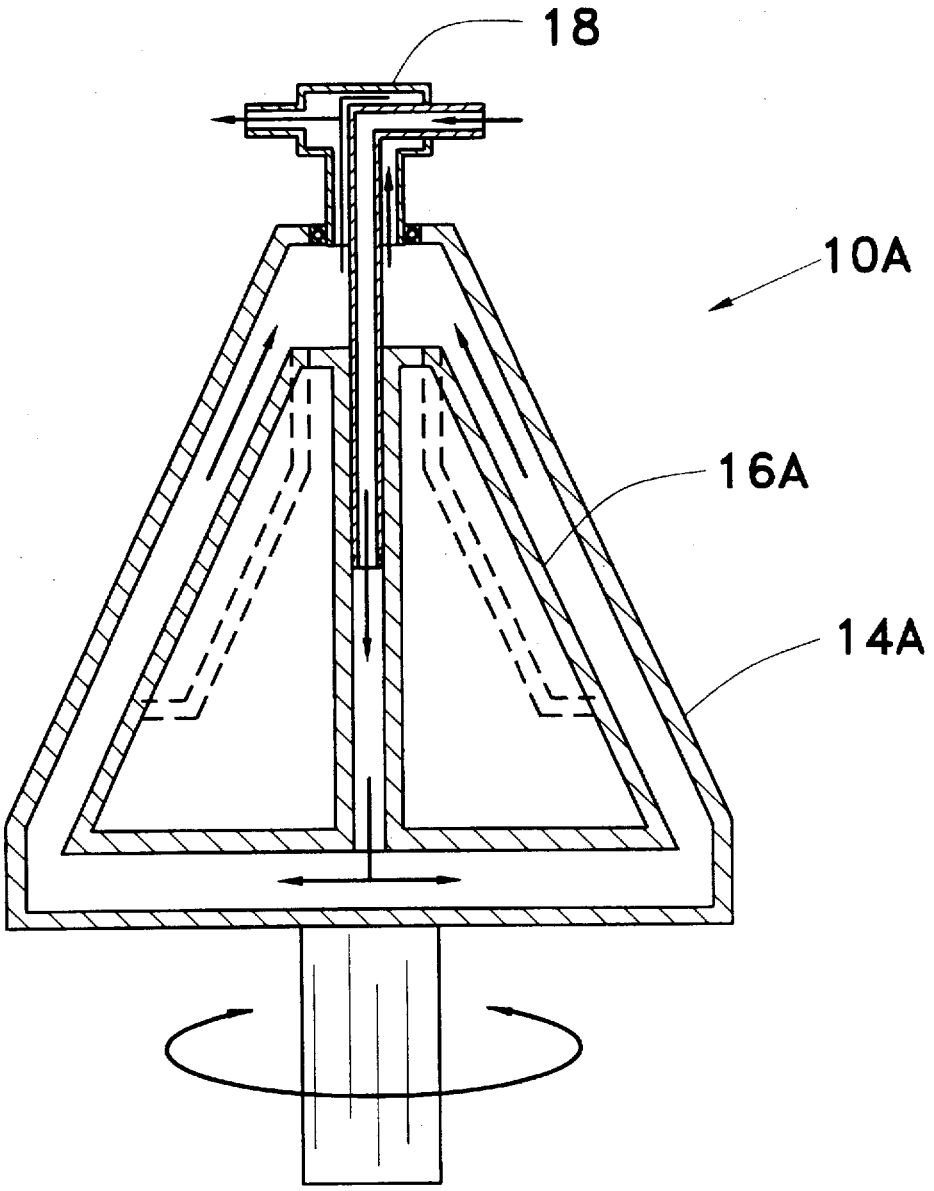
Fig. 1 (PRIOR ART)
FIG. 1 is an elevation view, in section, of a conventional centrifugal separator having a replaceable bowl.
Figure 2:
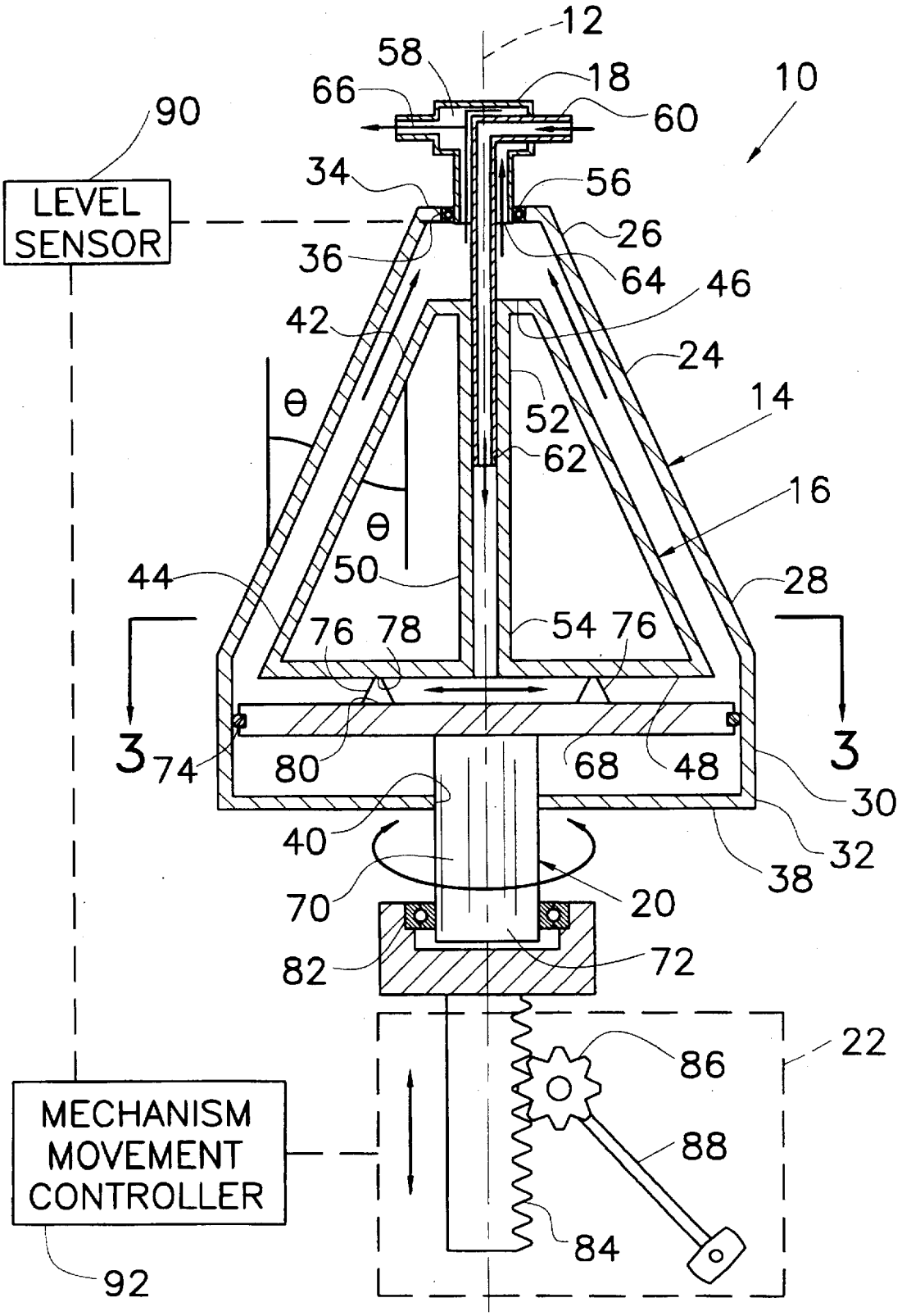
FIG. 2 is an elevation view, in section, of the variable volume cell saver bowl constructed in accordance with several features of the present invention.

As illustrated in FIG. 2, the bowl 10 of the present invention is comprised generally of an outer shell 14 and an inner shell 16. The outer shell 14 defines first and second side walls 24,30. The first side wall 24 defines a frusto-conical configuration terminating at an upper end 26 having a first inside diameter and at a lower end 28 having a second, larger inside diameter. The outer shell first side wall 24 is sloped at an angle θ with respect to the central axis 12 of the bowl 10. The outer shell second side wall 30 defines a cylindrical configuration having the second inside diameter defined by the lower end 28 of the outer shell first side wall 24. To this extent, the outer shell second side wall 30 is secured to the outer shell first side wall 24 at the lower end 28 thereof. Preferably, the outer shell first and second side walls 24,30 are integrally formed. Upper and lower end walls 34,38 are provided for closing the upper end 26 of the outer shell first side wall 24 and the lower end 32 of the outer shell second side wall 30, respectively.

The inner shell 16 is disposed concentrically within the outer shell 14 and defines a frusto-conical configuration sloped at the angle θ with respect to the central axis 11 of the bowl 10. The upper end 41 of the inner shell 16 defines an outside diameter substantially equal to the first inside diameter of the outer shell first side wall 24. The lower end 44 of the inner shell 16 defines an outside diameter larger than the first inside diameter but smaller than the second inside diameter defined by the outer shell first side wall 224. Thus, the inner shell 16 is shorter than the first side wall 24 of the outer shell 14 when measured along the central axis 11 of the bowl 10. Upper and lower end walls 46,48 are provided for closing the upper and lower ends 42,44 of the inner shell 16, respectively. A hollow core 50 is carried within the inner shell 16 between the upper and lower ends 42,44 thereof. In the preferred embodiment, the core 50 opens at a proximal end 52 on the upper end wall 46 and at a distal end 54 on the lower end wall 48 of the inner shell 16. The core 50 is concentrically disposed within the inner shell 16 such that the inner shell 16 and core 50 form a substantially toroidal configuration having a trapezoidal cross-section.

The outer shell upper end wall 44 defines an opening 36 for receiving an inlet/outlet coupling 18. In order to allow rotation of the bowl 10 about its central axis 12, the outer shell 14 is secured to the inlet/outlet coupling 18 using a bearing 56, seal (not shown), or other such device. The coupling 18 defines an inner volume 58 through which waste fluid is evacuated. Received through the inner volume 58 is an inlet tube 60 for communicating blood from a blood source (not shown) through the inlet/outlet coupling 18 to the core 50 of the inner shell 16. The inlet tube 60 exits the coupling 18 at a point coincident with the central axis 12 of the bowl 10 and extends into the core 50 of the inner shell 16. A seal 61 is provided between the inlet tube 60 and the inner shell core 50 in order to prevent blood from seeping therebetween.

The outlet portion of the coupling 18 defines a mouth 64 having an annular opening around and concentric with the inlet tube 60 extending into the bowl 10. An outlet 66 is defined by the coupling 18 for evacuation of the waste fluid. Thus, as blood is introduced through the inlet tube 60, it is passed through the inner shell core 50 to the volume defined between the inner and outer shells 16,14. The red blood cells are centrifuged out of the blood and the remaining fluid is evacuated through the outlet 66 of the inlet/outlet coupling 18.

Figure 3:
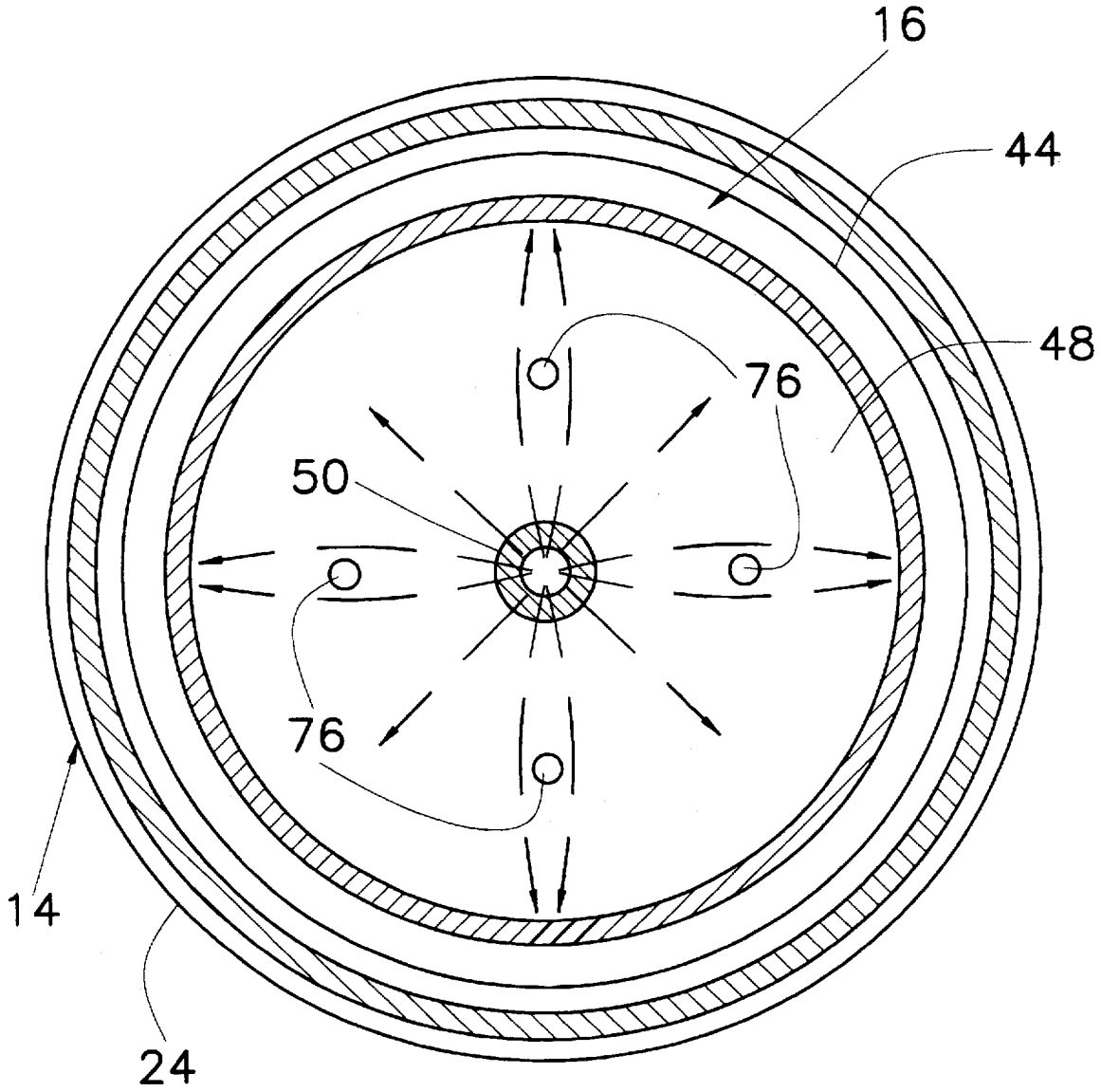
FIG. 3 is a plan view, in section, of the variable volume cell saver bowl taken at 3—3 of FIG. 2.

In order to centrifuge the blood, the bowl 10 is rotated about its central axis 12. The inlet/outlet coupling 18 is stationary with respect to the bowl 10, as a result of the bearing 56 provided between the upper end wall 34 of the outer shell 14 and the inlet/outlet coupling 18. In order to accomplish rotation of the bowl 10, a piston 20 is secured to the inner shell 16 and a rotation imparting force is applied to the piston 20 or the outer shell 14. To this extent, a piston head 68 is secured to the inner shell lower end wall 48 via at least one spacer 76. Each spacer 76 is secured at one end 80 to the piston head 68 and at the other end 78 to the inner shell lower end wall 48 such that the inner shell 16 is fixed in relation to the piston 20. FIG. 3 is an illustration of the relative spacing of four spacers 76. The piston head 68 is configured to be closely received within the second side wall 30 of the outer shell 14. A seal 74 is carried by the piston head 68 and is interposed between the piston head 68 and the outer shell second side wall 30. The piston 20 includes a shaft 70 carried by the piston head 68 and received through an opening 40 defined by the outer shell lower end wall 38. In order to impart rotation on the outer shell 14, the piston shaft 70 and the opening 40 may be keyed, may define a noncircular cross-section, or may be otherwise configured to prohibit rotation of the outer shell 14 with respect to the piston shaft 70, while allowing axial movement of one with respect to the other. A conventional rotation imparting device (not shown) is used to impart rotation on the piston shaft 70, and thus the piston head 68, the inner shell 16 and the outer shell 14. The rotation imparting device is used to create centrifugal forces within the bowl 10, thus causing the components of the blood to separate.

In order to accommodate for variation in volumes during operation of the bowl 10, the bowl 10 of the present invention is provided with a linear displacement device 22. The linear displacement device 22 is journalled to the distal end 72 of the piston shaft 70 using a conventional bearing 82 such that the piston shaft 70 may rotate while the linear displacement device 22 remains relatively still. In the illustrated embodiment, the linear displacement device 22 includes a rack 84 and pinion 86 device whereby as a crank 88 is turned, whether electrically or mechanically, automatically or manually, the rack 84 portion of the linear displacement device 22 is moved linearly, thus moving the inner shell 16 toward either the upper or lower end wall 34,38 of the outer shell 14, thus reducing or increasing the volume within the bowl 10. Although a rack 84 and pinion 86 device is illustrated, it will be understood that any conventional linear displacement 22 device may be used to control the volume within the bowl 10.

Thus, when it is necessary to reduce the volume within the bowl 10, the inner shell 16 is moved toward the upper end wall 34 of the outer shell 14. Similarly, when the volume within the bowl 10 needs to be increased, the linear displacement device 22 is operated to move the inner shell 16 toward the lower end wall 38 of the outer shell 14.

As indicated with broken lines in FIG. 2, a level sensor 90 may be provided for sensing when the volume within the bowl 10 is filled with red blood cells. The level sensor 90 is of a conventional type such as an infrared detector, a light beam, or otherwise, and is disposed proximate the upper end 26 of the outer shell first end wall :14. Such a level sensor 90 may be used as a result of the separation of the red blood cells from the fluid in the blood. The fluid is clear, therefore allowing detection between the two components. Further, in order to assist in accomplishing detection of a filled bowl 10, the outer shell 14 is fabricated from a transparent material. When the level sensor 90 detects that the bowl has been filled with red blood cells, a mechanism movement controller 91 serves to cease rotation of the bowl 10, and further to halt operation of the linear displacement device 12. In the instance where the linear displacement device 22 is not being operated, but where the level of red blood cells has reached its limit, the linear displacement device 12 may be activated to increase the volume within the bowl 10, or the rotation of the bowl 10 may be ceased. When such has been ceased, the red blood cells may be removed from the bowl 10 and re-introduced into the blood system of the patient.

From the foregoing description, it will be recognized by those skilled in the art that a variable volume cell saver bowl offering advantages over the prior art has been provided. Specifically, the variable volume cell saver bowl provides a means whereby the volume within the bowl may be varied during operation of the bowl. In particular, the volume within the bowl may be reduced during operation in order to accommodate smaller volumes of collected blood such that the red blood cells may be centrifuged out of the remaining fluid in order for the red blood cells to be re-introduced into the blood system from which they were recovered. Thus, the hematocrit level may be raised when required without the need for waiting for the bowl to be filled. Further, when no more blood is to be collected, the blood within the bowl may be centrifuged and the red blood cells used, as opposed to the entire blood collection being disposed as required in prior art devices.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, we claim:

1. A variable volume cell saver bowl for use in centrifuging red blood cells from a collection of blood, said variable volume cell saver bowl being used in conjunction with a conventional inlet/outlet coupling and a conventional rotation imparting device, the inlet/outlet coupling having a housing through which passes a centrally disposed blood inlet and an annular waste fluid outlet disposed about the blood inlet, the blood inlet extending from the housing at a first end thereof, said variable volume cell saver bowl comprising:

an outer shell having a side wall, an upper end wall, and a lower end wall, said side wall having a cross-section defining a selected configuration and having an upper end and a lower end, said upper end wail being configured to substantially cover said upper end and said lower end wail being configured to substantially cover said lower end, said upper end wail defining a first opening for receiving the inlet/outlet coupling;

an inner shell disposed concentrically within said outer shell and defining a substantially similar configuration as at least a portion of said outer shell side wall, said inner shell being movable along a central axis defined by said outer shell in order to vary a volume defined between said outer shell and said inner shell; and a linear displacement device for moving said inner shell within said outer shell along said outer shell central axis.

2. The variable volume cell saver bowl of claim 1 wherein said outer shell side wall includes first and second side walls, said first side wall defining a frusto-conical configuration having a first inside diameter at an upper end and a second inside diameter at a lower end, said first side wall defining a slope of angle θ with respect to said outer shell central axis, said second side wall having said second inside diameter and extending from said first side wall lower end, said upper end wall being configured to cover said upper end of said first side wall, said lower end wall being configured to substantially cover a lower end of said second side wall.

3. The variable volume cell saver bowl of claim 2 wherein said inner shell includes a side wall defining a frusto-conical configuration with a slope of angle θ with respect to said outer shell central axis, said inner shell further including a hollow core having a proximal end opening on an inner shell upper end wall and a distal end opening on an inner shell lower end wall, said inner shell thus defining a toroidal configuration having a trapezoidal cross-section.

4. The variable volume cell saver bowl of claim 3 wherein said linear displacement device includes a piston having a piston head and a piston shaft, said piston head being configured to be received within said outer shell second side wall, said piston head carrying a seal about a perimeter thereof in order to define a first discrete volume above said piston head and a second discrete volume below said piston head, said piston shaft being secured at a proximal end to said piston head and extending through a second opening defined by said outer shell lower end wall and coaxially with said outer shell central axis, said linear displacement device further including a reciprocating shaft coupled to said piston shaft via a bearing, said reciprocating shaft carrying a rack portion of a rack and pinion gear, a pinion portion being disposed to cooperate with said rack portion when said pinion portion is rotated, said linear displacement device further including a crank for turning said pinion portion of said rack and pinion gear, said variable volume cell saver bowl further comprising at least one spacer secured between said piston head and said inner shell lower end wall.

5. The variable volume cell saver bowl of claim 2 further comprising a bearing disposed between said outer shell upper end wall first opening and the inlet/outlet coupling.

6. A variable volume cell saver bowl for use in centrifuging red blood cells from a collection of blood, said variable volume cell saver bowl being used in conjunction with a conventional inlet/outlet coupling and a conventional rotation imparting device, the inlet/outlet coupling having a housing through which passes a centrally disposed blood inlet and an annular waste fluid outlet disposed about the blood inlet, the blood inlet extending from the housing at a fist end thereof, said variable volume cell saver bowl comprising:

an outer shell having a first side wall, a second side wall, an upper end wall, and a lower end wall, said first side wall defining a frusto-conical configuration having a first inside diameter at an upper end and a second inside diameter at a lower end, said first side wall defining a slope of angle θ with respect to said outer shell central axis, said second side wall having said second inside diameter and extending from said first side wall lower end, said upper end wall being configured to cover said upper end of said first side wall, said lower end wall being configured to substantially cover a lower end of said second side wall, said upper end wall defining a first opening for receiving the inlet/outlet coupling, said outer shell being journalled to the inlet/outlet coupling via a bearing disposed between said outer shell upper end wall first opening and the inlet/outlet coupling;

an inner shell disposed concentrically within said outer shell and defining a substantially similar configuration as at least a portion of said outer shell, said inner shell including a side wall defining a frusto-conical configuration with a slope of angle θ with respect to said outer shell central axis, said inner shell further including a hollow core having a proximal end opening on an inner shell upper end wall and a distal end opening on an inner shell lower end wall, said inner shell thus defining a toroidal configuration having a trapezoidal cross-section, said inner shell being movable along a central axis defined by said outer shell in order to vary a volume defined between said outer shell and said inner shell; and a linear displacement device for moving said inner shell within said outer shell along said outer shell central axis, said linear displacement device including a piston having a piston head and a piston shaft, said piston head being configured to be received within said outer shell second side wall, said piston head carrying a seal about a perimeter thereof in order to define a first discrete volume above said piston head and a second discrete volume below said piston head, said piston shaft being secured at a proximal end to said piston head and extending through a second opening defined by said outer shell lower end wall and coaxially with said outer shell central axis, said linear displacement device further including a reciprocating shaft coupled to said piston shaft via a bearing, said reciprocating shaft carrying a rack portion of a rack and pinion gear, a pinion portion being disposed to cooperate with said rack portion when said pinion portion is rotated, said linear displacement device further including a crank for turning said pinion portion of said rack and pinion gear, said variable volume cell saver bowl further comprising at least one spacer secured between said piston head and said inner shell lower end wall.

* * * * *

UNITED STATES PATENT AND TRADEMARK OFFICE

CERTIFICATE OF CORRECTION

PATENT NO. : 5,728,040
DATED : March 17, 1998
INVENTOR(S) : Schill, David M. and Schill, Joseph G.

It is certified that error appears in the above-identified patent and that said Letters Patent is hereby corrected as shown below:

Title page, Item [54] and Column 1, line 1,
Title, change "VARIABLE VOLUME CELL SAVER BOWL" to read
-- VARIABLE VOLUME BOWL FOR COLLECTING RED BLOOD CELLS --.

Item [57], ABSTRACT,
Lines 1 and 3, delete each occurrence of the phrase "cell saver".

Column 1,
Line 6, delete the phrase "cell saver".

Column 2,
Lines 49 and 65, delete each occurrence of the phrase "cell saver".

Column 4,
Lines 4, 7, 12 and 14, delete each occurrence of the phrase "cell saver".

Column 6,
Lines 33, 35, 56, 58 and 64, delete each occurrence of the phrase "cell saver".

Column 7,
Lines 16, 28, 36, 53, 56, 59 and 61, delete each occurrence of the phrase "cell saver".

Column 8,
Lines 5 and 57, delete each occurrence of the phrase "cell saver".

Signed and Sealed this

Twentieth Day of August, 2002

*Attest:*

*Attesting Officer*

JAMES E. ROGAN
*Director of the United States Patent and Trademark Office*